US007121874B1

(12) United States Patent
Jeon

(10) Patent No.: US 7,121,874 B1
(45) Date of Patent: Oct. 17, 2006

(54) FLEXIBLE PRINTED CIRCUIT (FPC) EDGE CONNECTOR

(76) Inventor: Myoungsoo Jeon, 39422 Zacate Ave., Fremont, CA (US) 94539

( * ) Notice: Subject to any disclaimer, the term of this patent is extended or adjusted under 35 U.S.C. 154(b) by 0 days.

(21) Appl. No.: 11/236,140

(22) Filed: Sep. 26, 2005

(51) Int. Cl.
*H01R 12/24* (2006.01)
*H01R 24/00* (2006.01)

(52) U.S. Cl. ..... 439/495; 439/630

(58) Field of Classification Search ..... 439/630, 439/637, 495, 497, 498, 499, 67
See application file for complete search history.

(56) References Cited

U.S. PATENT DOCUMENTS

| | | | | |
|---|---|---|---|---|
| 4,753,005 | A * | 6/1988 | Hasircoglu | 29/829 |
| 5,385,478 | A * | 1/1995 | Niekawa | 439/67 |
| 5,580,272 | A | 12/1996 | Yamaguchi et al. | 439/495 |
| 5,632,646 | A | 5/1997 | Ii et al. | 439/495 |
| 5,695,360 | A | 12/1997 | Seto et al. | 439/495 |
| 5,904,586 | A | 5/1999 | Takayasu | 439/260 |
| 6,116,947 | A | 9/2000 | Takayasu | 439/495 |
| 6,186,811 | B1 | 2/2001 | Tojo et al. | 439/260 |
| 6,383,017 | B1 | 5/2002 | Takayasu | 439/495 |
| 6,386,905 | B1 * | 5/2002 | Ito | 439/495 |
| 6,884,108 | B1 | 4/2005 | Saito et al. | 439/495 |
| 6,932,648 | B1 * | 8/2005 | Chiu et al. | 439/607 |
| 7,021,969 | B1 * | 4/2006 | Matsunaga | 439/630 |
| 2002/0197906 | A1 * | 12/2002 | Fuerst et al. | 439/495 |

OTHER PUBLICATIONS

"Silicon Pipe—Copper at the Speed of Glass", web page downloaded from www.siliconpipe.com on Sep. 26, 2005, 2 pages.

* cited by examiner

*Primary Examiner*—Hien Vu
(74) *Attorney, Agent, or Firm*—Imperium Patent Works; T. Lester Wallace; Darien K. Wallace

(57) ABSTRACT

A flexible printed circuit (FPC) connector is surface mountable on a printed circuit board (PCB). An edge of an FPC is insertable into a slot in the connector so that contact beams in the connector press on corresponding conductors in the FPC, thereby making electrical contact with the FPC conductors. Each contact beam is mounted on and is coupled to a conductor of a substrate member within the connector. The substrate member has a microstrip design so that the characteristic impedance of a signal path from an FPC conductor, through a contact beam, through a surface mount attachment structure of the connector, and to a conductor in the PCB has only a small variation. The contact beam is not part of a fork-shaped metal clamp that has a spring portion and a radiating stiffening portion, but rather is a beam that presses on the FPC from one side only.

19 Claims, 14 Drawing Sheets

MICROSTRIP STRUCTURE OF CONDUCTORS AND GROUND PLANE

MICROSTRIP STRUCTURE OF CONDUCTORS AND GROUND PLANE

PARALLEL INSERTION EMBODIMENT

PERPENDICULAR INSERTION EMBODIMENT

ZERO INSERTION FORCE EMBODIMENT

FPC INSTALLED AFTER PCB ASSEMBLY

FLEXIBLE PRINTED CIRCUIT (FPC) EDGE CONNECTOR

TECHNICAL FIELD

The present invention relates generally to high-speed connectors.

BACKGROUND INFORMATION

FIG. 1 (Prior Art) is a perspective view of a type of connector, referred to here as a flexible printed circuit (FPC) connector. An edge 1 of an FPC 2 slides into an accommodating receiving slot 3 in an FPC connector 4. FPC connector 4 is mounted on a printed circuit board (PCB) 5. Inserting FPC edge 1 into the slot 3 in FPC connector 4 causes each one of a plurality of conductors on the bottom of FPC 2 to be coupled through FPC connector 4 to a corresponding one of a plurality of surface mount leads 6 on the connector. These surface mount leads 6 are coupled to traces in the PCB 5 so that conductors in the FPC 2 are coupled to traces in PCB 5 as desired.

FIG. 2 (Prior Art) is a more detailed cross sectional view of the FPC connector 4 of FIG. 1. FPC connector 4 includes an insulative housing 7, and a plurality of metal fork clamping contact structures. The metal fork clamping contact structures are typically stamped out of a sheet of metal. One of the metal fork clamping contact structures 8 is illustrated in FIG. 2. One end of structure 8 has a spring beam 9 and a stiff support portion 10. When the edge 1 of FPC 2 is forced into slot 3, the FPC 2 forces the spring beam 9 down such that the spring beam pushes on a conductive surface on the bottom of FPC 2. FPC 2 is therefore clamped between spring beam 9 and the stiff support portion 10 of the metal contact. Stiff support portion 10 ensures that over time the upward force of spring beam 9 pressing on FPC 2 does not distort the softer plastic insulative material of housing 7 and cause the connector to fail. The other end of structure 8 forms surface mount lead 11. Surface mount lead 11 is one of surface mount leads 6. FPC connector 4 involves many such metal fork clamping structures, disposed parallel to one another as illustrated in FIG. 2.

FIG. 3 (Prior Art) illustrates how FPC connector 4 is fabricated. The metal fork clamping structures are slid in the direction of arrow A into the insulative housing 7 of connector 4. Insulative housing 7 is typically a single piece of plastic material.

FPC connectors of the type illustrated in FIGS. 1–3 are used in numerous applications in electrical equipment. For example, the liquid crystal display (LCD) screen of a laptop computer usually is disposed on a hinged cover panel of the laptop computer whereas the keyboard and CPU of the laptop computer are disposed in the main lower panel to which the cover panel is hinged. Information to be displayed on the screen is driven from the electronics in the main lower panel, through the hinge, and to the screen in the cover panel. An FPC extends from the main electronics in the main lower panel, through the hinge, into the cover panel, and into a receiving slot in an FPC connector in the cover panel. Through the electrical connections provided by this FPC connector, the electronics in the main panel communicates information to the LCD in the cover panel so that the information can be displayed on the LCD screen of the laptop.

With larger and higher resolution LCD displays being used in laptop computers, there is a need to communicate higher and higher speed signals through the FPC connectors in the hinges of the laptop computers. The FPC connector of the type illustrated in FIGS. 1–3, however, does not have good performance characteristics for signals above approximately one gigabit per second. An improved FPC connector is desired.

SUMMARY

A flexible printed circuit (FPC) connector is surface mountable on a printed circuit board (PCB). An edge of an FPC is insertable into a slot in the connector. In one embodiment, the connector is of a type that can be employed to couple electronics in a main panel of a laptop computer to other electronics (for example, an LCD display) in a cover panel of the laptop computer. The slot extends in parallel to the surface of the PCB along a side edge of a housing of the connector.

When the FPC is in its final position in the slot, contact beams within the connector press on corresponding conductors in the FPC, thereby making electrical contact with the FPC conductors. Each contact beam is mounted on and is coupled to a conductor of a substrate member within the connector. The substrate member has a microstrip-like design so that the characteristic impedance of a signal path from a conductor in the FPC conductor, through a contact beam, through a surface mount attachment structure of the connector, and to a conductor in the PCB has only a small variation. The characteristic impedance through this signal path in one embodiment varies by less than plus or minus ten percent. Where the FPC has a certain conductor, ground plane, and dielectric geometry, the substrate member within the FPC connector can have substantially the same conductor, ground plane and dielectric geometry so that the characteristic impedance through the FPC connector substantially matches the characteristic impedance through the FPC.

Each contact beam of the PFC connector is not part of a fork-shaped metal clamp that has both a spring portion as well as another stiffening portion that can radiate energy, but rather is a single beam that presses on the FPC from one side only. In one embodiment, the FPC connector further includes a stiffening member that contacts the side of the FPC opposite the contact beam. The stiffening member provides rigidity so that the connector does not distort over time under pressures and forces due to the FPC being lodged in the slot. Where the stiffening portion is made of metal, the metal is not electrically connected to the contact beam on the opposite side of the FPC in the slot.

The surface mount attachment structure may, for example, be an end of a strip of metal where the opposite end of the strip of metal is one of the contact beams. The end of the strip of metal that is the surface mount attachment structure is bent to form a surface mount attachment tab. In an alternative embodiment, the surface mount attachment structure is a solder ball of a type used to surface mount to a PCB. The solder ball is attached to the bottom surface of the substrate member. An opening is provided in the insulative housing so that the solder ball (which is attached to the bottom surface of the substrate member) extends down through the opening so that the solder ball protrudes below the bottom surface of the insulative housing of the FPC connector. In the alternative embodiment, the electrical path extends from a conductor of the FPC, through a contact beam, through the substrate member from the contact beam on one side of the substrate member to a solder ball on the other side of the substrate member, and then to a conductor of the PCB.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 4:
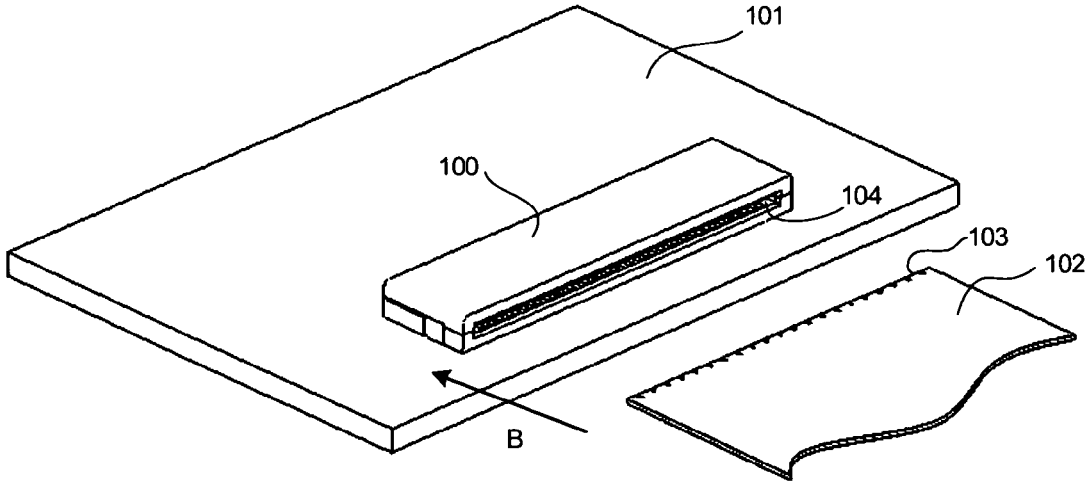
FIGS. 4 and 5 are perspective views of a novel FPC connector in accordance with one embodiment.

FIG. 4 is a perspective view of a flexible printed circuit (FPC) edge connector 100 in accordance with one embodiment. FPC edge connector 100 is surface mounted onto on a standard relatively rigid printed circuit board 101. To couple conductors (not shown in FIG. 4) on the bottom surface of an FPC 102 to surface mount leads (not shown in FIG. 4) of connector 100, an edge 103 of FPC 102 is slid in the direction of arrow B into a printed circuit edge (PCE) receiving slot 104 in connector 100. PCE receiving slot 104 extends in a direction that is parallel to the upper surface of PCB 101. FPC 102 is, for example, a flexible printed circuit of a type that sees common use in electronics and has metal conductors disposed on a flexible thin substrate (the substrate is typically made of polyimide (Kapton), polyester (Mylar) or Teflon).

Figure 5:
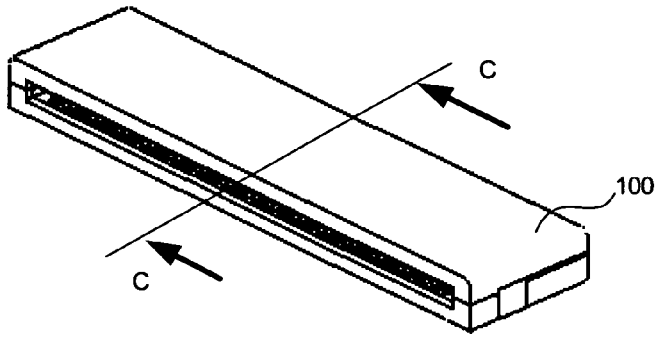

FIG. 5 is a perspective diagram of FPC connector 100 of FIG. 4.

Figure 6:
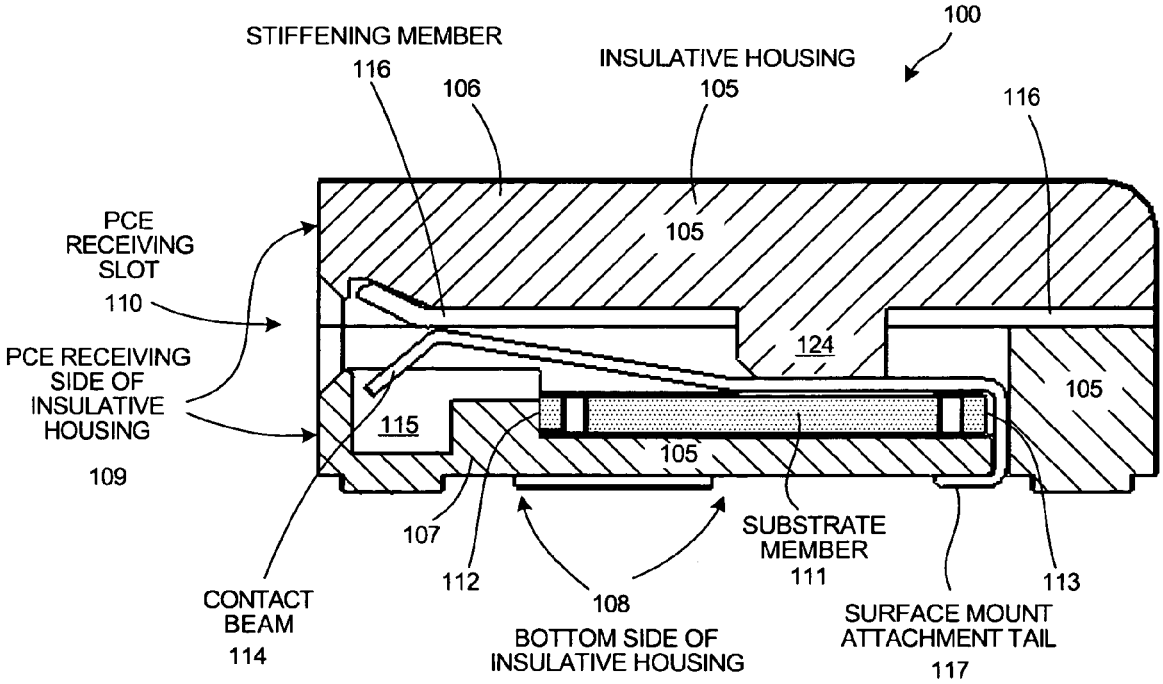
FIG. 6 is a cross-sectional diagram of the FPC connector of FIG. 5.

FIG. 6 is a cross-sectional view of FPC connector 100 taken along sectional line C—C of FIG. 5. FPC connector 100 includes an insulative housing 105 that includes a first portion 106 and a second portion 107. Insulative housing 105 has a substantially rectangular bottom side 108 that is placed face down on the surface of printed circuit board 101 (see FIG. 4) when the FPC connector is surface mounted to PCB 101. Insulative housing 105 also has an printed circuit edge (PCE) receiving side 109 that is the left side of insulative housing 105 as the insulative housing 105 is pictured in FIG. 6. PCE receiving slot 110 is formed in insulative housing 105 so that an opening of PCE receiving slot 110 is in the PCE receiving side 109.

Insulative housing 105 retains a rectangular substrate member 111. Substrate member 111 is seen in cross-section in FIG. 6. Substrate member 111 may, for example, be a printed circuit board or a flexible printed circuit. In the embodiment illustrated, substrate member 111 is a two-sided printed circuit board. Substrate member 111 has a first longitudinal edge 112 (that extends perpendicularly into the page in the illustration of FIG. 6) and a second longitudinal edge 113 (that extends perpendicularly into the page in the illustration of FIG. 6). The term longitudinal here means that the first and second edges of rectangular substrate member 111 are longer than the shorter other edges of the rectangular substrate member 111.

FPC connector 100 also includes a plurality of contact beams. Each contact beam is coupled to a corresponding one of a plurality of conductors of substrate member 111. One contact beam 114 is illustrated in cross-section in FIG. 6. In the cross-sectional view of FIG. 6, there is no FPC edge inserted into PCE receiving slot 110 of FPC connector 100. Contact beam 114 is therefore in the up position. If an FPC edge were inserted into PCE receiving slot 110, then contact beam 114 would be pushed down such that the angled end portion of contact beam 114 would fit down into an accommodating recess 115 in insulative housing 105. Accommodating recess 115 is an open volume for accommodiating the first end of contact beam 114 when the contact beam is depressed by printed circuit 102.

FPC connector 100 also includes a stiffening member 116. Stiffening member 116 is provided to stiffen and strengthen the relatively soft insulative housing 105 so that the ceiling of PCE receiving slot 10 does not deform and distend over time under pressure from contact beam 114 and the edge of the FPC that is present in slot 110. Stiffening member 116 is retained in insulative housing 105 such that stiffening member 116 forms at least a portion of a ceiling of PCE receiving slot 110 as illustrated.

In the illustrated example, contact beam 114 is a first end of a strip of metal. The strip of metal extends down around the second longitudinal edge 113 of substrate member 111 and through the bottom side 108 of insulative housing 105 so that a second end of the strip of metal forms a surface mount attachment tail 117 on the bottom of connector.

Figure 7:
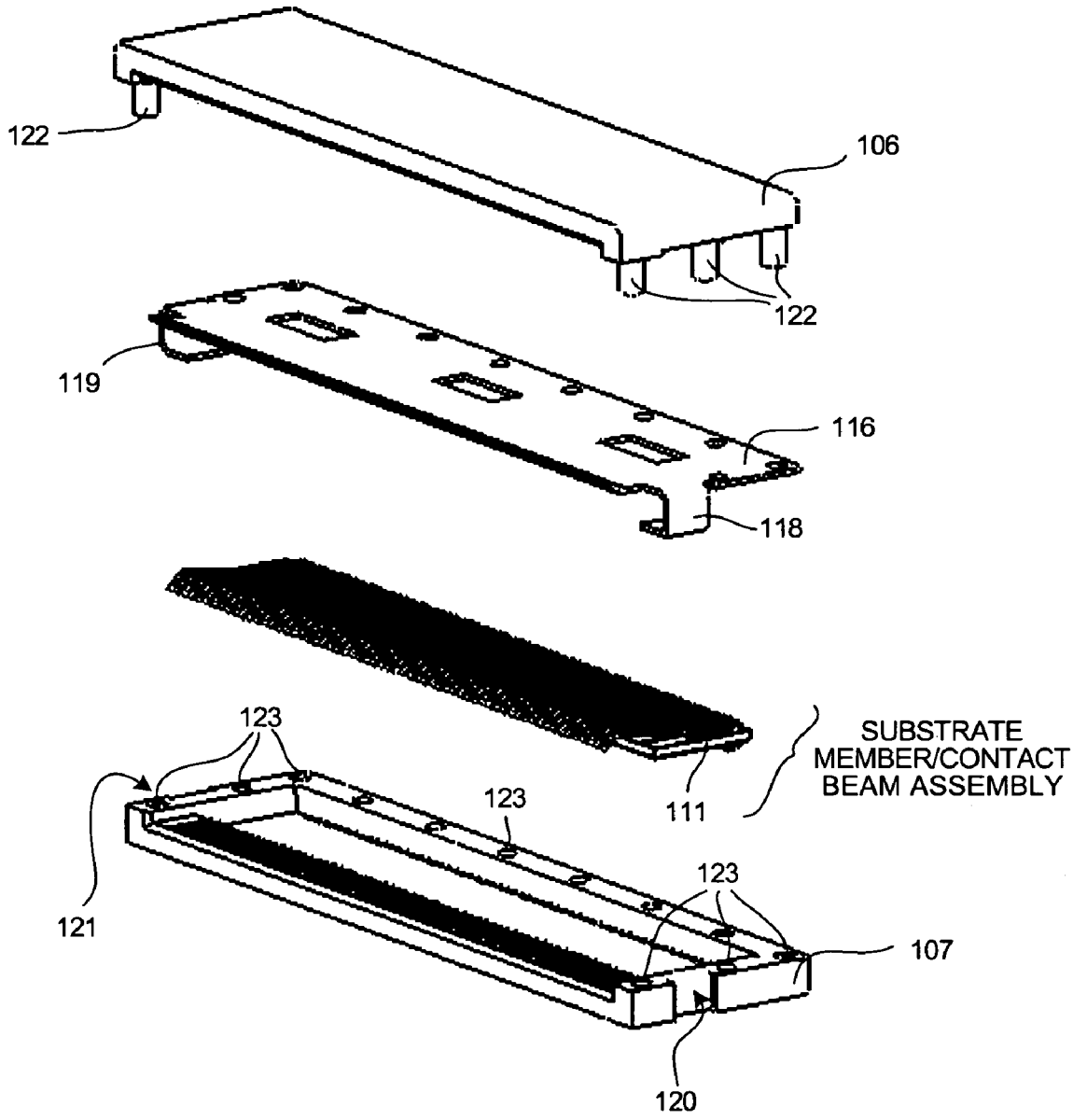
FIG. 7 is an exploded view of the FPC connector of FIG. 4.

FIG. 7 is an exploded perspective view of the parts of FPC connector 100. Stiffener member 116 has clasping portions 118 and 119 that fit into and around accommodating grooves 120 and 121 in second portion 107 of housing 105. Guide pins 122 on the bottom of first portion 106 of housing 105 extend down through holes in stiffener member 116 and into receiving holes 123 in second portion 107 of housing 105. The contact beams are seen in FIG. 7 extending to the left beyond the first longitudinal edge 112 of substrate member 111.

Figure 8:
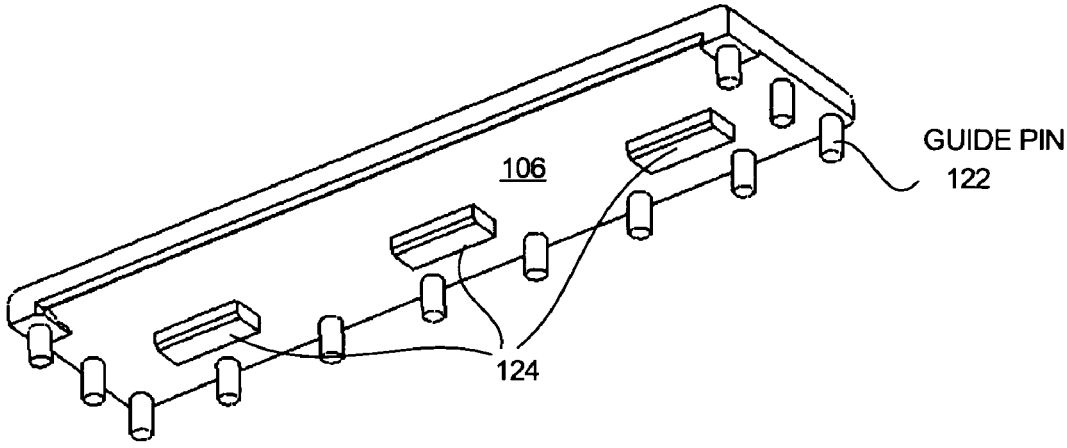
FIG. 8 is a perspective view of a first portion (an upper portion) of the insulative housing 105 of the FPC connector of FIG. 4.
Figure 9:
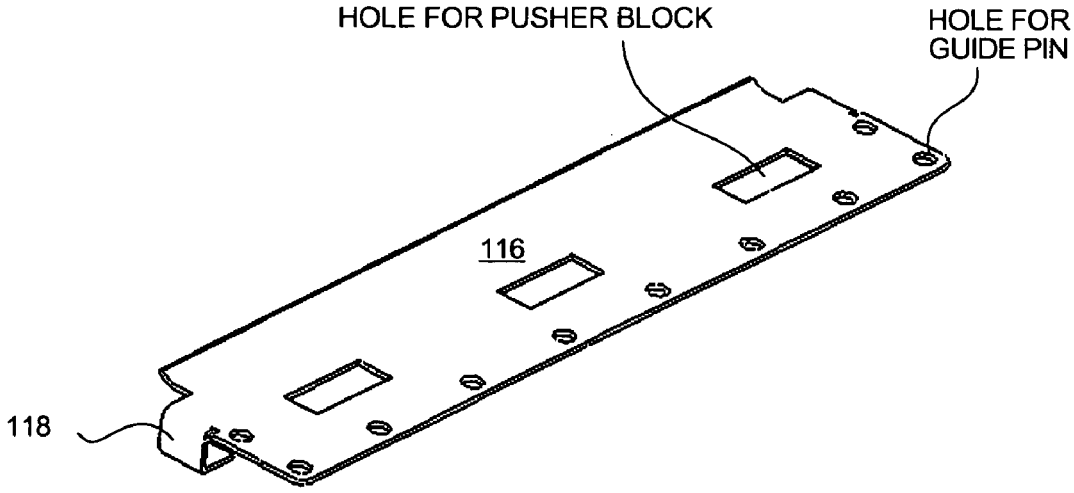
FIG. 9 is a perspective view of a stiffening member of the FPC connector of FIG. 4.

FIG. 8 is a more detailed diagram of the bottom surface of first portion 106 of housing 105. There are three pusher blocks 124 that extend down from the first portion 106 of housing 105. These pusher blocks extend through three corresponding openings in stiffening member 116 so that the pusher blocks can push down on substrate member 111, thereby holding substrate member 111 down in the cavity in housing 105.

Figure 10:
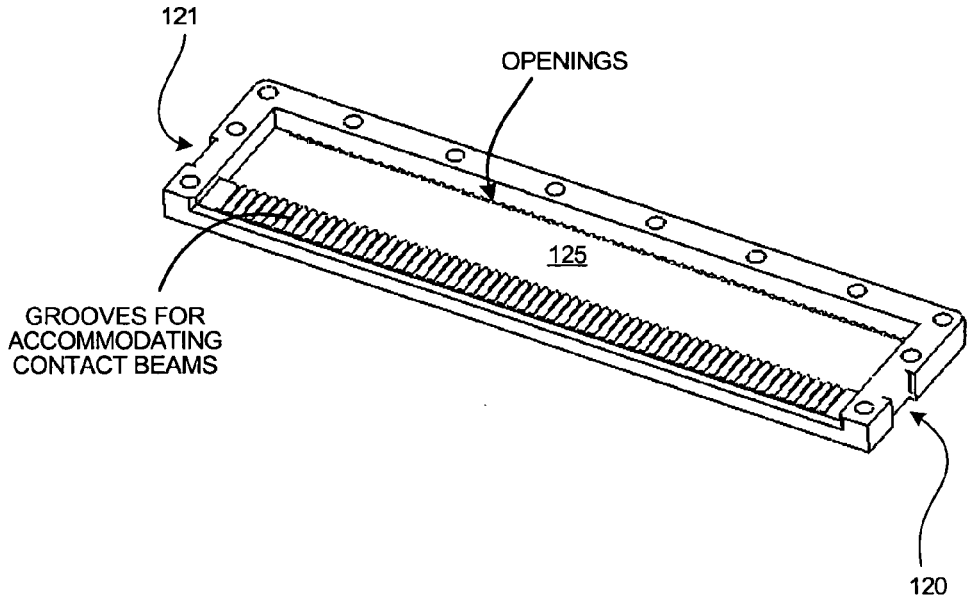
FIG. 10 is a top-down perspective view of a second portion (a lower portion) of the insulative housing 105 of the FPC connector of FIG. 4.

FIG. 10 is a more detailed perspective view of second portion 107 of housing 105. A groove is provided for each contact beam for accommodating each contact beam when the contact beam is in a depressed condition. The strip-shaped recess 125 in second portion 107 is provided to accommodate rectangular substrate member 111.

Figure 11:
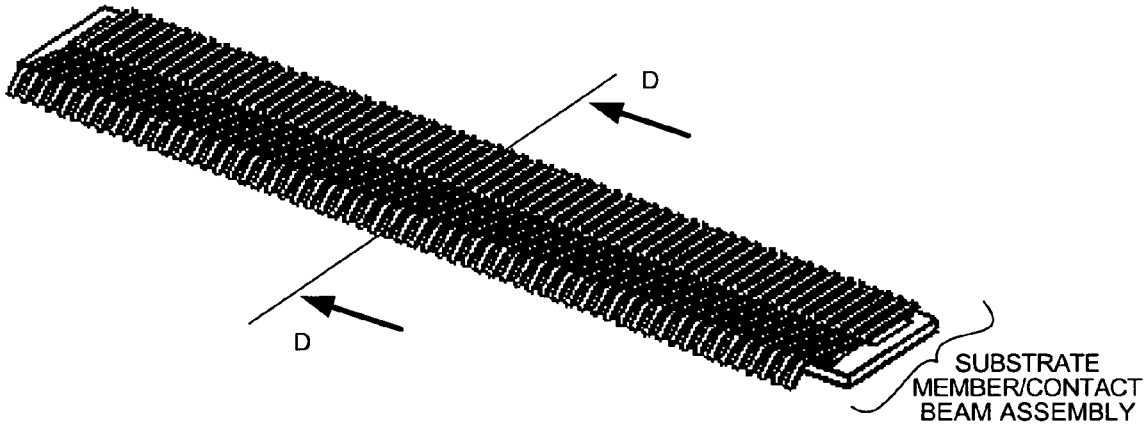
FIG. 11 is a perspective view of the substrate member and contact beam assembly of the FPC connector of FIG. 4.

FIG. 11 is a more detailed perspective view of the contact beams and substrate member assembly.

Figure 12:
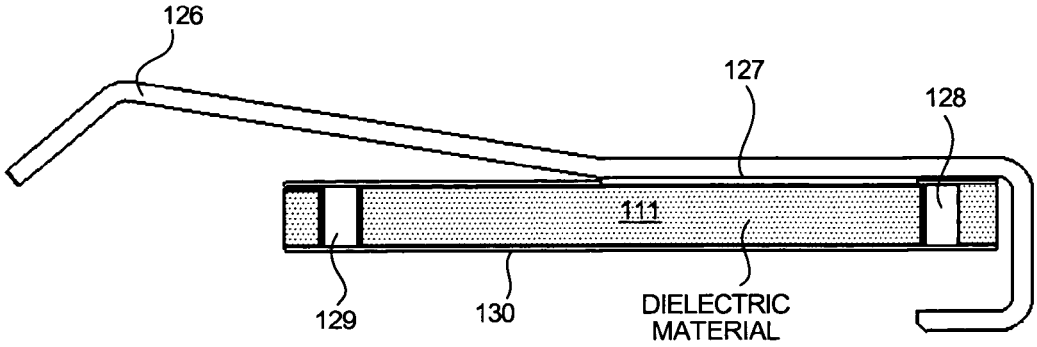
FIG. 12 is a cross-sectional side view of the substrate member and contact beam assembly taken along line D—D of FIG. 11.

FIG. 12 is a cross-sectional view taken along sectional line D—D in FIG. 11. The contact beam 126 illustrated is a ground contact beam. It is coupled to a conductor 127 on the top of substrate member 111. Contact beam 126 and conductor 127 are coupled by a pair of conductive vias 128 and 129 (plated through holes) to a ground plane conductor 130 on the bottom surface of substrate member 111.

Figure 13:
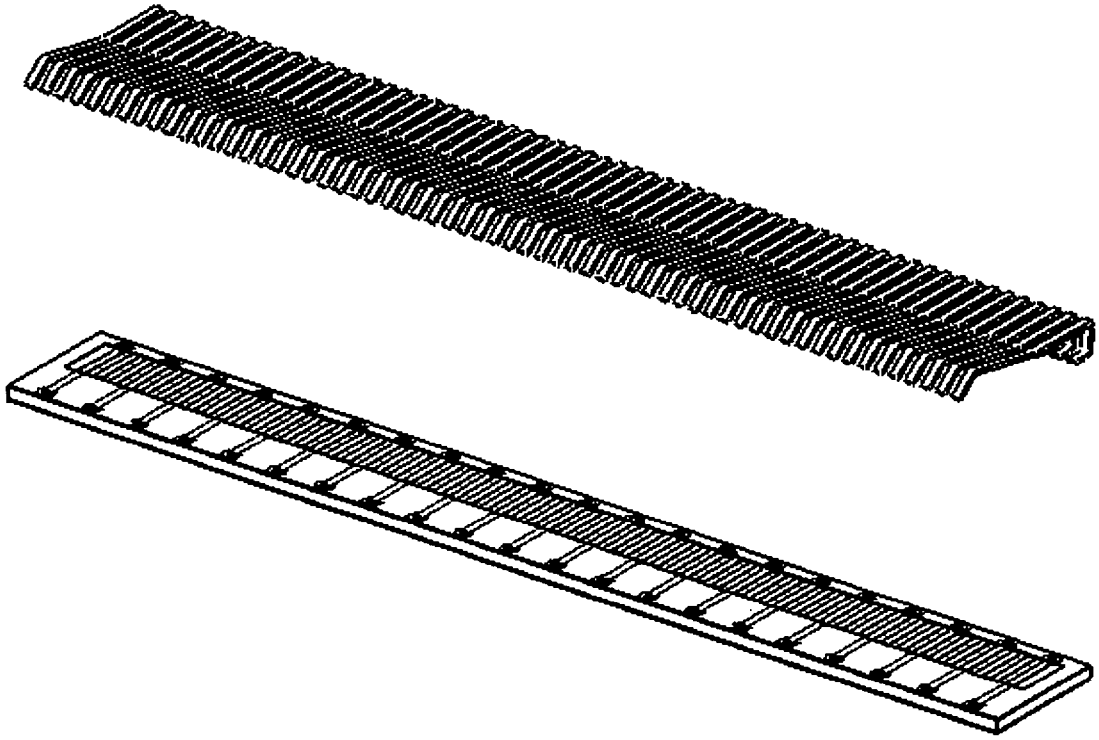
FIG. 13 is an exploded view of the substrate member and contact beam assembly of FIG. 11.

FIG. 13 is an exploded perspective view of the contact beam and substrate member assembly seen in FIG. 11.

Figure 14:
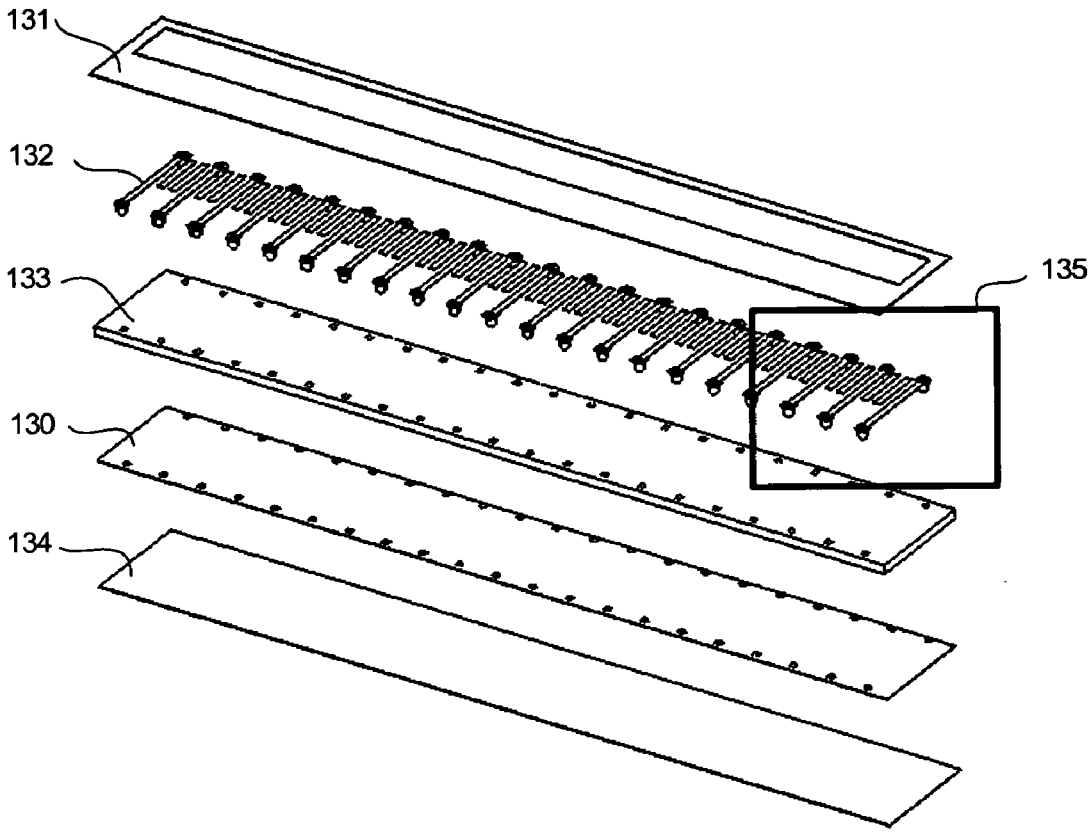
FIG. 14 is an exploded view of the various layers of the substrate member in FIG. 13.

FIG. 14 is an exploded view of the substrate member 111 of FIG. 13. In the illustrated example, substrate member 111 is a printed circuit board that includes the following layers: 1) an upper solder mask layer 131, 2) an upper ground and signal conductor layer 132, 3) a dielectric layer 133, 4) the lower conductive ground plane layer 130, 5) and a bottom solder mask layer 134.

Figure 15:
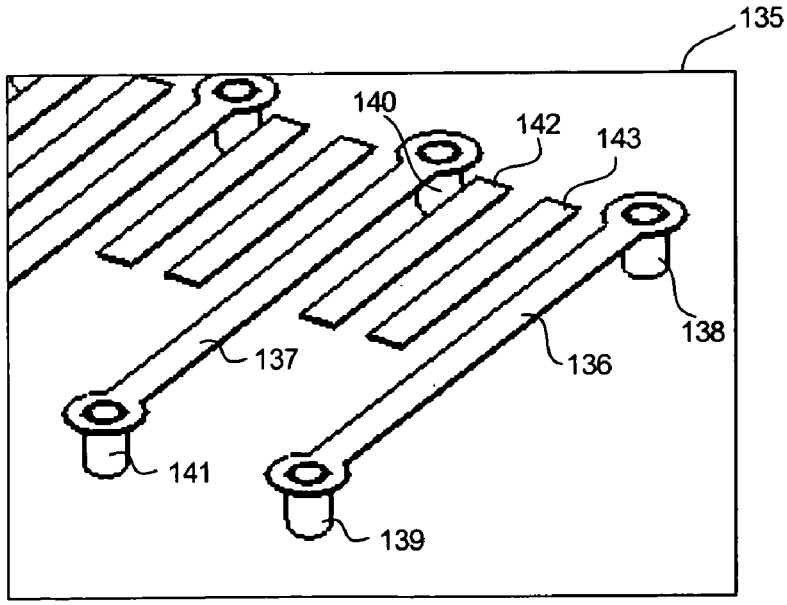
FIG. 15 is a more detailed view of the conductor structure within the box labeled 135 in FIG. 14.

FIG. 15 is a more detailed diagram of the portion of layer 132 within box 135 of FIG. 14. The longer conductors 136 and 137 that are coupled to conductive vias 138–141 are ground conductors. The shorter conductors 142 and 143 are signal conductors.

Figure 16:
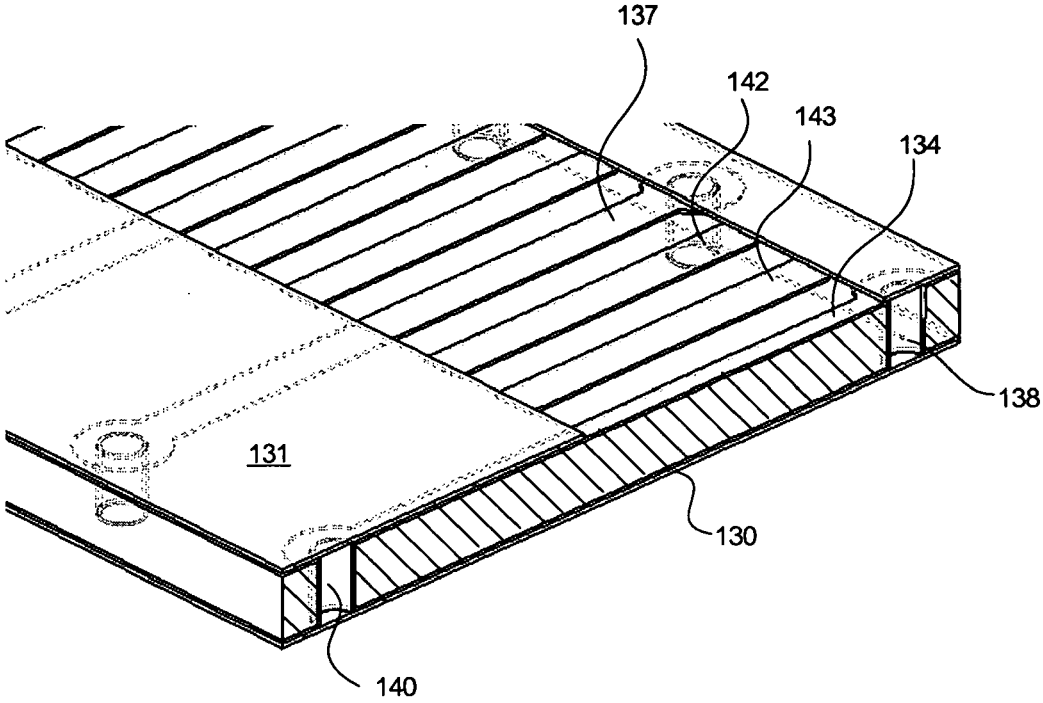
FIG. 16 is a more detailed cut away perspective view of the substrate member of the FPC connector of FIG. 4.

FIG. 16 is a cut away perspective view of substrate member 111 showing the upper surface of substrate member 111. Solder mask layer 131 covers all of the upper surface but for a strip-like longitudinally-extending band. In this band, a surface of each of the ground and signal conductors is exposed so that it can be contacted by a corresponding contact beam.

Figure 17:
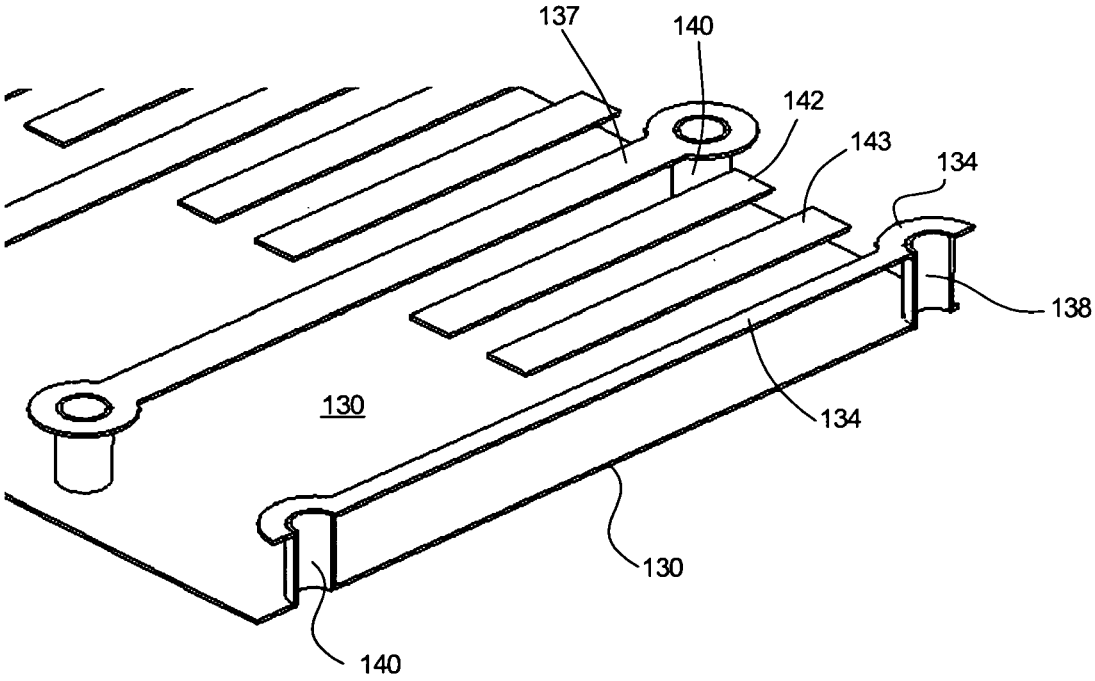
FIG. 17 is a more detailed cut away perspective view like that of FIG. 16 except that the dielectric layer and the solder mask layers are not illustrated.

FIG. 17 is a cut away perspective view of the structure of FIG. 16, except that the dielectric material and the solder mask layers are not illustrated. The diagram of FIG. 17 illustrates how the ground conductors 134 and 137 on the top of substrate member 111 are coupled to the ground plane on the bottom of the substrate member 111 through conductive vias. All of the grounded conductors form a sort of grounded sheath on most of three sides around the two inner signal conductors 142 and 143.

Figure 1:
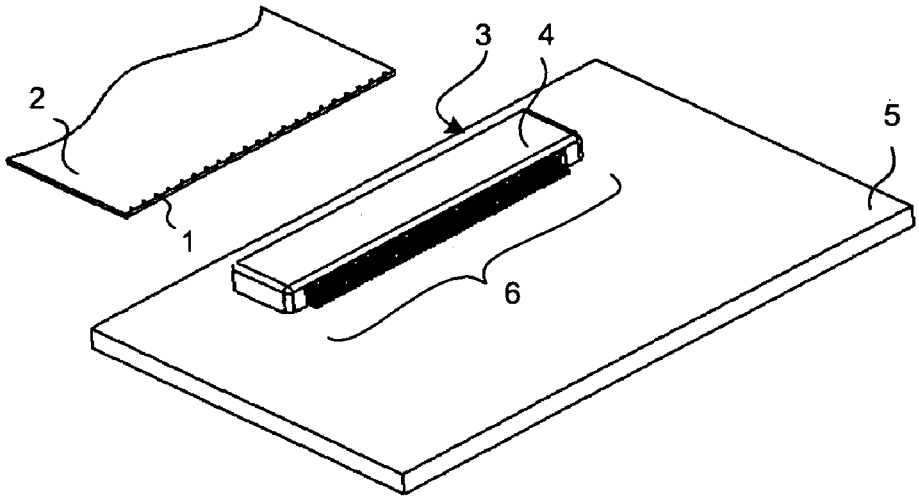
FIG. 1 PRIOR ART
FIGS. 1–3 (Prior Art) are views of a conventional FPC connector.
Figure 2:
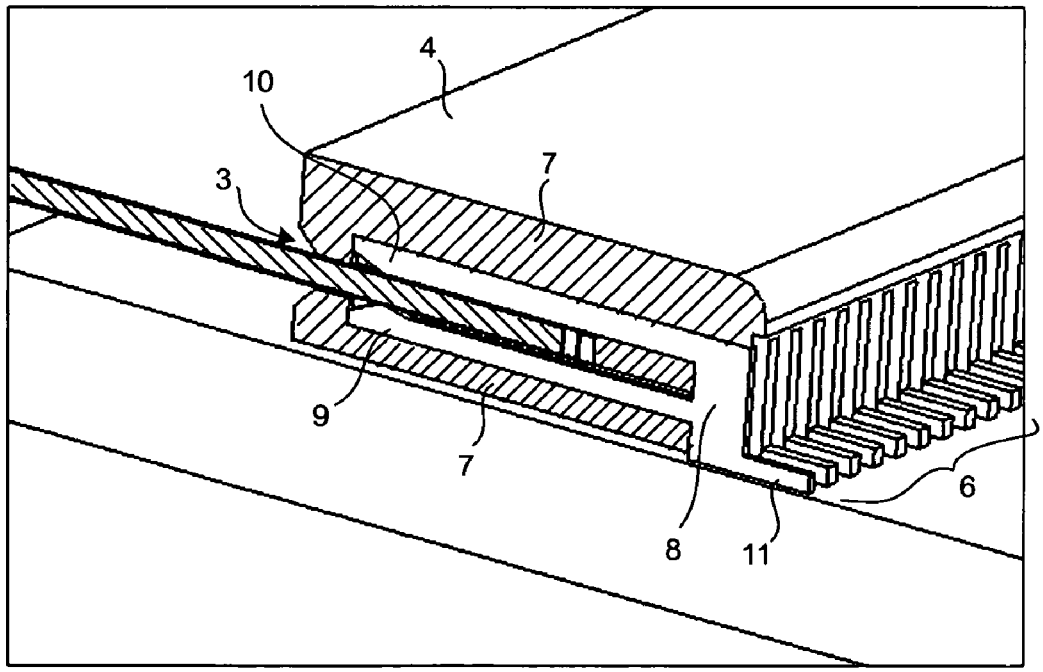
FIG. 2 PRIOR ART
Figure 3:
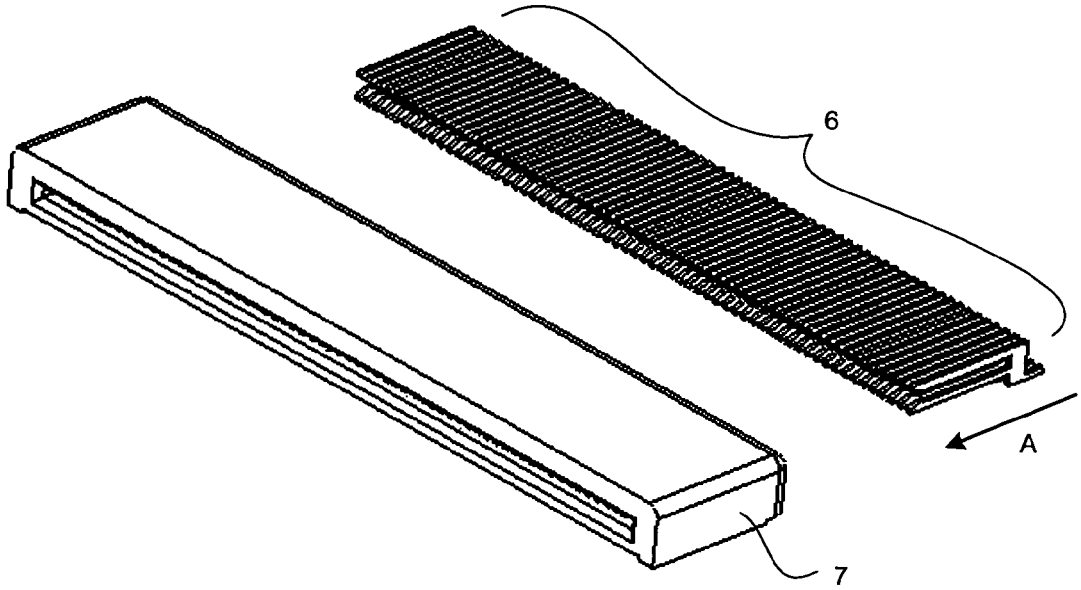
FIG. 3 PRIOR ART
Figure 18:
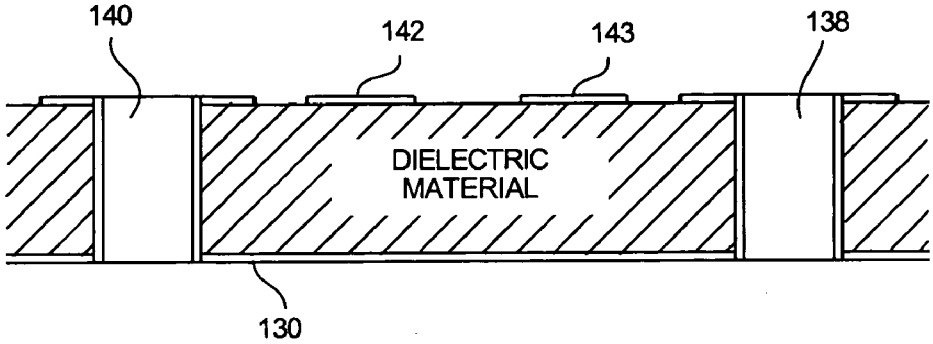
FIG. 18 is a simplified cross-sectional diagram of the signal conductor and ground plane and dielectric layer structure of the substrate member of the FPC connector of FIG. 4.

FIG. 18 is cross-sectional view of substrate member 111 where the first longitudinal edge of the substrate member is disposed in the orientation of the page. Two signal conductors 142 and 143 are surrounded on three side (the right, bottom and left) by conductive via 138, ground plane 130, and conductive via 140. The structure has a microstrip structure. In one embodiment, the structure, materials, dimensions, and electrical characteristics of the substrate member 111 are made to match the structure, materials, dimensions and electrical characteristics of FPC 102. By maintaining the dimensions and makeup of substrate member 111 and FPC 102 the same and by using microstrip structural relationships, the characteristic impedance from a conductor on the bottom of FPC 102, through FPC connector 100, and to a trace in PCB 101 is made to vary by not more than plus or minus ten percent. Due to the structure of the overall connector 100 including the microstrip structure illustrated in FIG. 17, the variation of characteristic impedance through the signal paths through connector 100 is improved with respect to the characteristic impedance through the signal paths through the prior art connector of FIG. 2.

Figure 19:
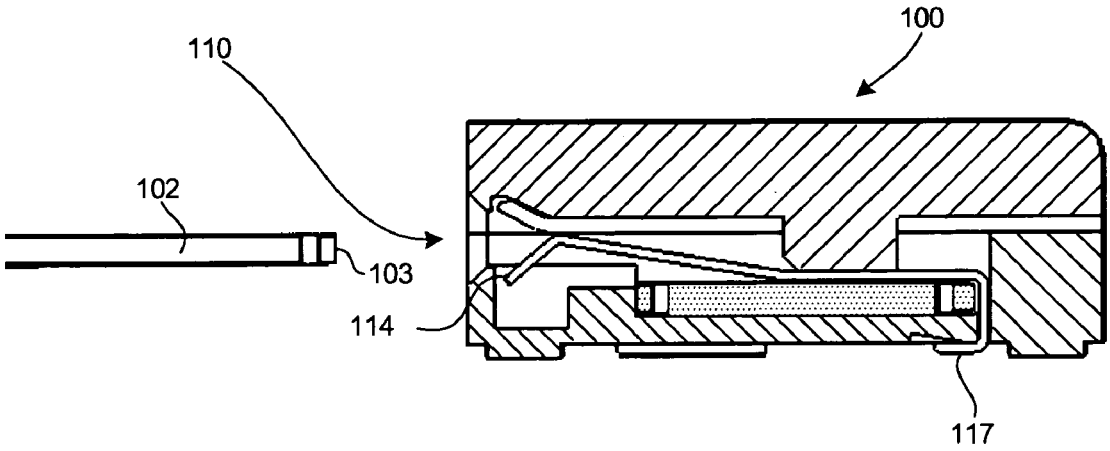
FIG. 19 is a cross-sectional view showing the FPC connector of FIG. 4 before FPC 102 is inserted into the PCE receiving slot in the FPC connector.

FIG. 19 is a cross-sectional view of FPC connector 100 before the edge 103 of FPC 102 is inserted into the PCE receiving slot 110 in FPC connector 100. Contact beam 114 is in the up position.

Figure 20:
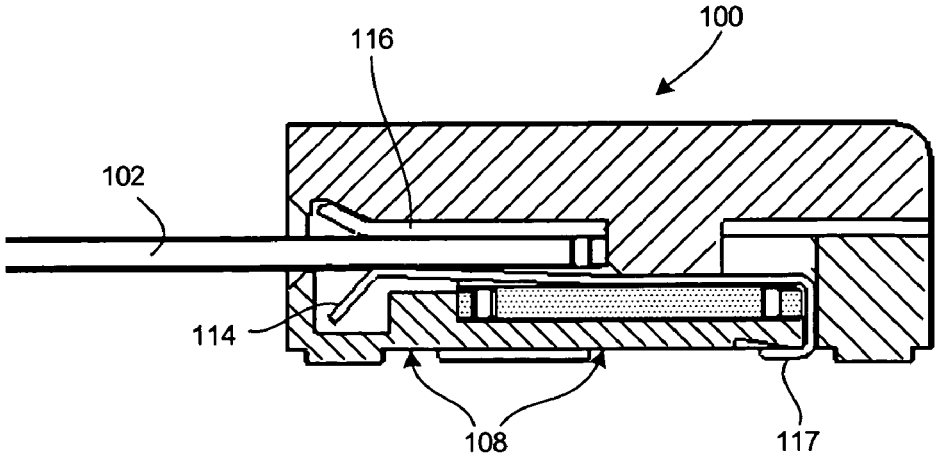
FIG. 20 is a cross-sectional view showing the FPC connector of FIG. 4 after FPC 102 has been inserted into the PCE receiving slot in the FPC connector.

FIG. 20 is a cross-sectional view of FPC connector 100 after the edge 103 of FPC 102 has been inserted into the PCE receiving slot 110 in FPC connector 100. Sliding edge 103 of PFC 102 into the PCE receiving slot 110 has forced contact beam 114 to bend downward into the depressed position illustrated in FIG. 20. The upper surface of FPC 102 is in contact with stiffening member 116. A conductor on the bottom surface of FPC 102 is in contact with contact beam 114. An electrical path is established from the conductor on the bottom of FPC 102, through contact beam 114, and to the surface mount attachment tail portion 117 on the bottom side 108 of the insulative housing of FPC connector 100. Stiffening member 116 can be electrically floating or grounded, but is not coupled to contact beam 114. There is no metal fork clamping structure where an upper stiffening portion (such as portion 10 illustrated in FIG. 2) of the fork structure can introduce a sharp discontinuity in characteristic impedance and can radiate electromagnetic radiation.

Figure 21:
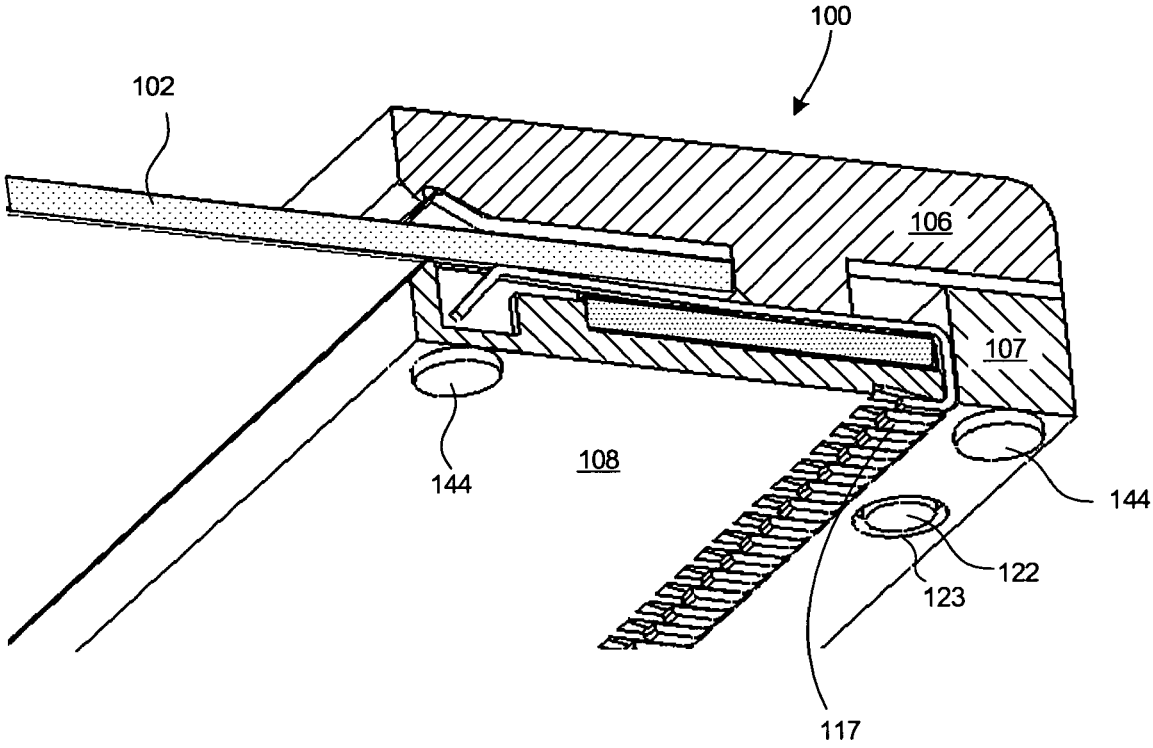
FIG. 21 is a more detailed cut away perspective view of the FPC connector of FIG. 4 showing the surface mount attachment structures on the bottom of the FPC connector.

FIG. 21 is a cut away perspective view of FPC connector 100 showing a part of bottom side 108. The bottom extent of a guide pin 122 of first housing portion 106 is seen disposed in one of the holes 123 in second housing portion 107. Once the substrate member and contact beams and stiffening member have been put in place and the first and second housing portions 106 and 107 have been pushed together so that the guide pins of the first housing portion 106 extend into the holes 123 in the second housing portion 107, the ends of the guide pins are melted so that they expand slightly, thereby permanently securing the first and second housing portions together. Standoff extensions 144 are provided extending from the bottom of second housing portion 107 so that a gap of approximately 50 microns exists between the upper surface of PCB 101 and the bottom of solder tail 117 of PFC connector 100.

Figure 22:
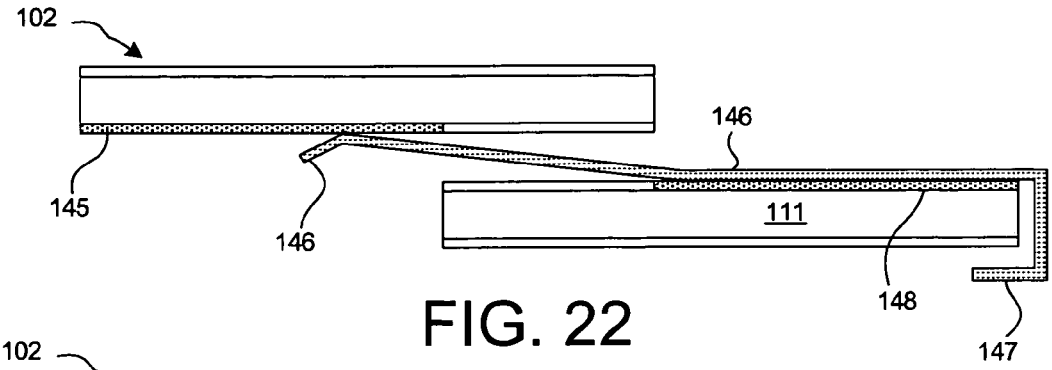
FIG. 22 is a simplified cross-sectional diagram that illustrates an electrical signal path from a conductor on FPC 102, through a contact beam of the FPC connector of FIG. 4, and to a surface mount attachment structure 147 of the FPC connector.

FIG. 22 is a simplified cross-sectional diagram that illustrates how a conductive path is formed from a signal conductor 145 on the bottom of FPC 102, through a contact beam 146, and to a surface mount attachment tail 147. This path is coupled to a signal conductor 148 in substrate member 111.

Figure 23:
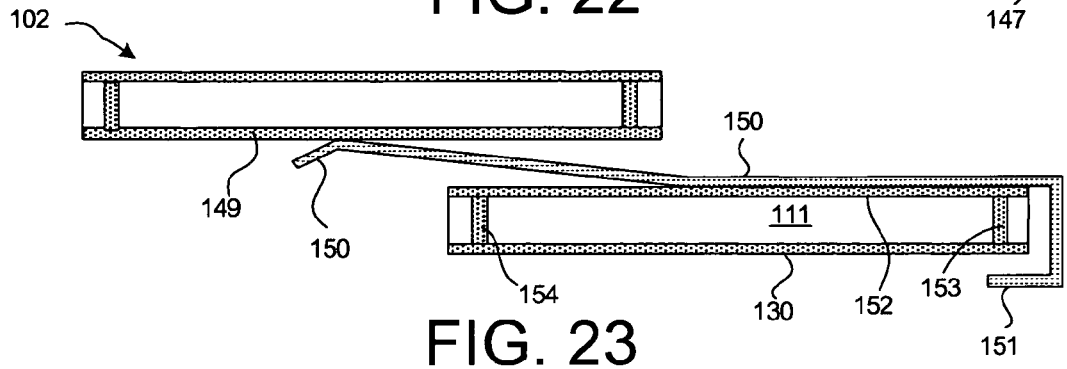
FIG. 23 is a simplified cross-sectional diagram that illustrates grounded structures in FPC 102 and how they are electrically connected by contact beam 150 to ground structures in substrate member 111 and to surface mount attachment structure 151.

FIG. 23 is a simplified cross-sectional diagram that illustrates how a conductive path is formed form from a ground conductor 149 on the bottom of FPC 102, through a contact beam 150, and to a surface mount attachment tail 151. This path is coupled to a ground conductor 152 on the upper surface of substrate member 111. This ground conductor 152 is in turn coupled to ground plane 130 on the bottom of substrate member 111 through conductive vias 153 and 154. In this embodiment, FPC 102 has substantially the same structure of ground conductors, conductive vias, and ground planes as does substrate member 111.

Figure 24:
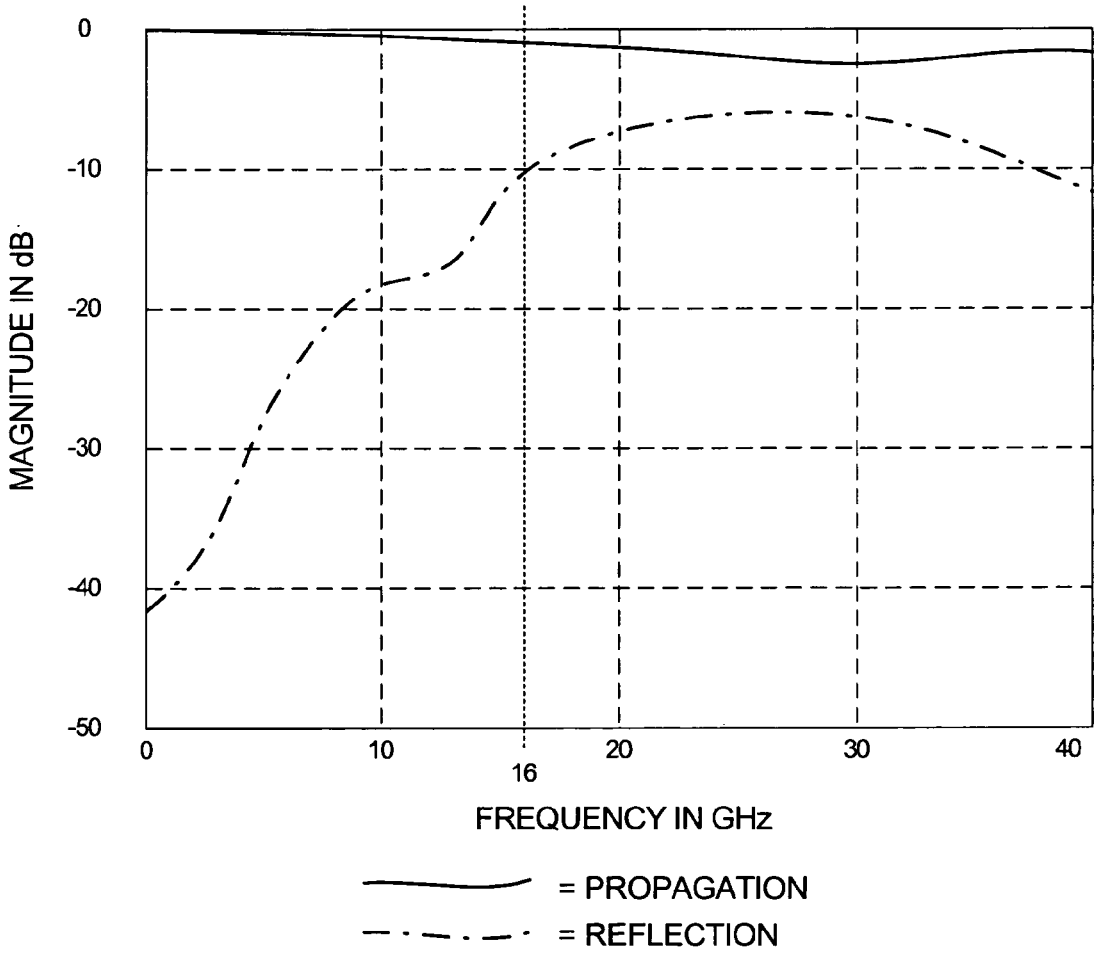
FIG. 24 is a chart showing electrical performance characteristics (S-parameter) of the FPC connector of FIG. 4.

FIG. 24 is a chart of a simulated electrical characteristic of FPC connector 100. Where performance standards for a connector require that the magnitude of reflections be less than −10 dB and that the degradation of signal propagation be less than −3 dB, the FPC connector 100 operates satisfactorily for frequencies up to approximately 16 gigabits per second. As illustrated in FIG. 24, at a signal rate of 16 gigabits per second, the degradation of signal propagation is approximately −1 dB, and the magnitude of reflections is approximately −10 dB.

Figure 25:
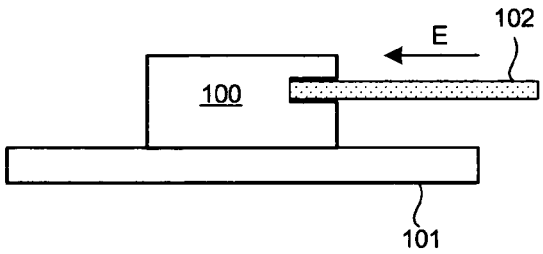
FIG. 25 is a simplified cross-sectional view of an FPC connector wherein FPC 102 is inserted horizontally from the side in a direction parallel to the upper side of the PCB to which the FPC connector is surface mounted.
Figure 26:
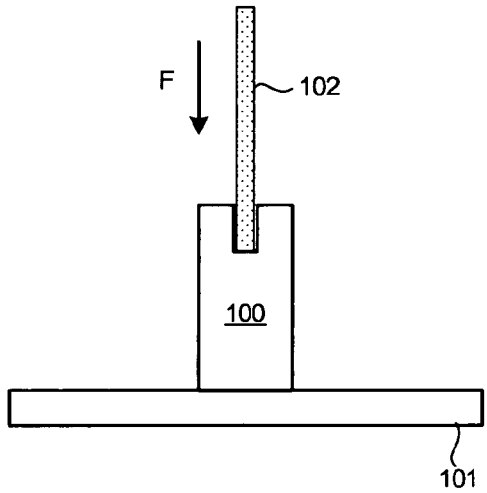
FIG. 26 is a simplified cross-sectional view of an FPC connector wherein FPC 102 is inserted vertically from the top in a direction perpendicular to the upper side of the PCB to which the FPC connector is surface mounted.
Figure 27:
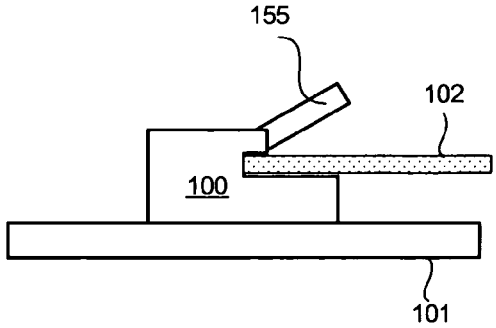
FIG. 27 is a simplified cross-sectional view of zero insertion force embodiment.

FIGS. 25–27 illustrate various orientations of the novel FPC connector 100. FIG. 25 illustrates a horizontal orientation where the edge of FPC 102 is inserted in horizontal direction E. Direction E is parallel to the upper surface of PCB 101 as illustrated in FIG. 4.

FIG. 26 illustrates a vertical orientation where the edge of FPC 102 is inserted from the top in vertical direction F. Direction F is perpendicular to the upper surface of PCB 101.

FIG. 27 illustrates a ZIF (zero insertion force) embodiment wherein FPC 102 is placed into FPC connector 100 so that conductors on the bottom of FPC 102 rest on upward extending contact beams of FPC connector 100. Once FPC 102 is in place, then a hinged cover portion 155 of insulative housing 105 is rotated down to press FPC 102 downward into the contact beams. Hinged cover portion 155 snaps or locks in place.

Figure 28:
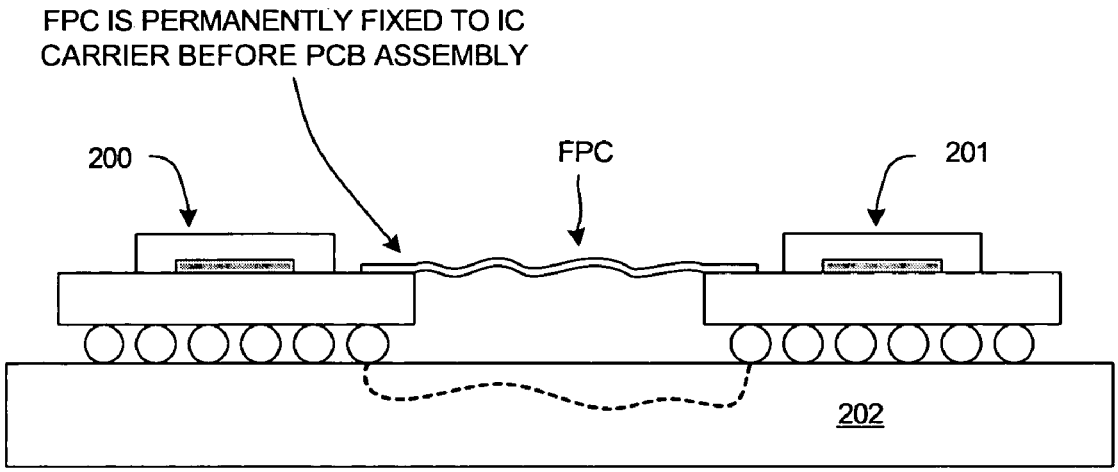
(PRIOR ART) FIG. 28
FIG. 28 (Prior Art) is a simplified cross-sectional diagram of a PCB assembly involving the communication of signals from one IC carrier on the PCB to another IC carrier on the PCB across a FPC.

FIG. 28 (Prior Art) is a simplified cross-sectional diagram of an assembly involving a pair of integrated circuit carriers 200 and 201. The integrated circuit carriers 200 and 201 have BGA (ball grid array) substrates so that the integrated circuit carriers can be surface mounted to a printed circuit board 202 as illustrated. Each integrated circuit carrier can include one or more integrated circuits. Where the conductive signal path from one carrier to another carrier through PCB 202 involves too much delay or is otherwise undesirable, a flexible printed circuit (FPC) is used to communicate signals directly from one carrier to the other without having to conduct the signals through the PCB. Conventionally, the FPC is permanently fixed to at least one of the carriers at the time the carriers are manufactured. The FPC is permanently fixed to the carrier prior to the carrier being surface mounted to PCB 202. The flexible FPC flopping around during the PCB assembly process is undesirable.

Figure 29:
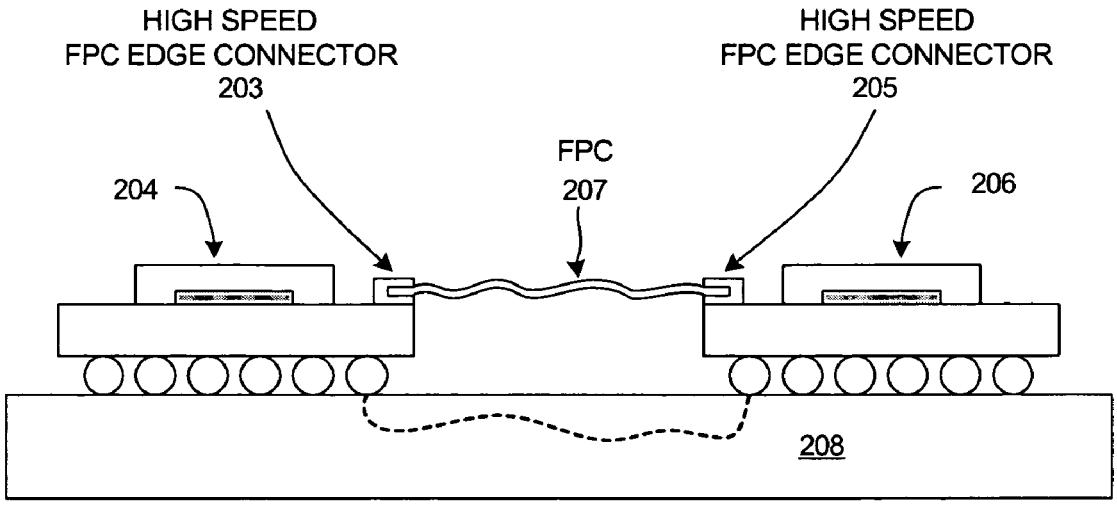
FIG. 29 is a simplified cross-sectional diagram that illustrates a novel use of the novel FPC edge connector of FIGS. 4–24. A novel FPC edge connector is surface mounted to each IC carrier so that the IC carriers can be surface mounted to the PCB without an FPC being attached. After PCB assembly the FPC is installed by inserting one end of the FPC into the PCE receiving slot of one IC carrier and inserting the other end of the FPC into the PCE receiving slot of the other IC carrier.

FIG. 29 is a simplified cross-sectional diagram that illustrates a novel use of the novel high speed FPC edge connector described above. Rather than the novel FPC edge connector being surface mounted to a PCB as in the examples set forth above, one high speed FPC edge connector 203 is surface mounted to integrated circuit carrier 204 and another high speed FPC edge connector 205 is surface mounted to integrated circuit carrier 206 as illustrated. The integrated circuit carriers may, for example, be BGA IC packages or multi-chip modules. Because an FPC can be removably inserted into the PCE receiving slot of the novel FPC edge connector, the carriers 204 and 206 bearing their FPC edge connectors are surface mounted to the PCB 208 during PCB assembly. After PCB assembly, FPC 207 is installed by inserting one end of FPC 207 into the PCE receiving slot in FPC edge connector 203 and by inserting the other end of FPC 207 into the PCE receiving slot in FPC edge connector 205. Manufacturability and reworkability and testing of the overall PCB assembly is thereby improved.

Although the present invention has been described in connection with certain specific embodiments for instructional purposes, the present invention is not limited thereto. Although the FPC edge connector is illustrated above as being surface mounted to a PCB, the FPC edge connector can be surface mounted to other types of surface mount substrates, including, for example, FPC substrates, ceramic substrates, and integrated circuit carriers and packages. The stiffening member can be coupled inside the FPC edge connector to ground, for example, by coupling the stiffening member to a solder tail that is coupled to ground on the PCB. In some embodiments the substrate member within the FPC edge connector is disposed in parallel orientation to the underlying PCB, whereas in other embodiments the substrate member within the FPC edge connector is disposed in perpendicular relation to the upper surface of the underlying PCB. Accordingly, various modifications, adaptations, and combinations of various features of the described embodiments can be practiced without departing from the scope of the invention as set forth in the claims.

What is claimed is:

1. A connector comprising:

a rectangular substrate member having a thickness, a first longitudinal edge and a second longitudinal edge, the substrate member further including a plurality of conductors wherein each conductor of the plurality of conductors extends from a location proximate to the first longitudinal edge across the substrate member to a location proximate to the second longitudinal edge, wherein the substrate member is taken from the group consisting essentially of: a printed circuit board (PCB) and a flexible printed circuit (FPC);

a plurality of contact beams, wherein each contact beam is coupled to a corresponding one of the plurality of conductors of the substrate member;

an insulative housing that has a substantially rectangular bottom side and a printed circuit edge (PCE) receiving side, the housing defining an PCE receiving slot in the PCE receiving side, the PCE receiving slot having an elongated opening at the PCE receiving side, the elongated opening extending longitudinally in a direction parallel to the bottom side of the housing and in a direction perpendicular to each of the contact beams, the opening of the PCE receiving slot also having a height dimension in a direction perpendicular to the bottom side of the housing, the height dimension being approximately equal to the thickness of the substrate member so that the PCE receiving slot can receive an edge of a printed circuit member that has the same approximate thickness as the thickness of the substrate member, the housing retaining the substrate member therein such that the contact beams are aligned in a row along a bottom of the PCE receiving slot proximate to the opening, wherein the plurality of conductors of the substrate member are couplable through the bottom side of the housing to a surface of a second printed circuit board when the bottom side of the housing is placed down on the surface of the second printed circuit board; and a metal stiffening member that is retained in the housing such that the stiffening member forms at least a part of a ceiling of the PCE receiving slot and at least one of the contact beams is not electrically coupled to the stiffening member, when the edge of the printed circuit member is received into the PCE receiving slot then the contact beams press against the printed circuit member and the printed circuit member contacts the stiffening member and the contact beams are electrically connected to the second printed circuit board.

2. The connector of claim 1, wherein the printed circuit member is a flexible printed circuit (FPC), wherein the printed circuit member is received into the PCE receiving slot, wherein the printed circuit member includes a conductor, and wherein the connector is surface mounted to the second printed circuit board, wherein a conductive path is established from the conductor of the printed circuit member, through the connector, and to the second printed circuit board, and wherein the conductive path has a characteristic impedance that varies by less than plus or minus ten percent.

3. The connector of claim 1, wherein the substrate member has a bottom surface and a top surface, the plurality of conductors being disposed at the top surface, the substrate member also having a ground plane conductor that is disposed at the bottom surface, the ground plane conductor being coupled to various ones of the plurality of conductors at the top surface.

4. The connector of claim 1, wherein none of the plurality of contact beams is electrically coupled to the stiffening member.

5. The connector of claim 1, further comprising:

a solder ball that is disposed in an opening in the bottom side, wherein the solder ball is coupled to one of the conductors of the substrate member.

6. The connector of claim 1, wherein each contact beam is a first end portion of a strip of metal, the strip of metal having a second end portion that extends through the bottom side of the insulative housing, the second end portion being a surface mount attachment structure for attaching the connector to the second printed circuit board if the bottom side of the housing is placed down on the surface of the second printed circuit board.

7. An assembly, comprising:

a surface mount substrate (SMS) having a conductor;

a connector comprising an insulative housing, a printed substrate member retained in the insulative housing, a contact beam coupled to the printed substrate member, a stiffening member, and a surface mount attachment structure, the surface mount attachment structure being connected to the SMS so that the connector is surface mounted onto the SMS, the printed substrate member having a signal conductor on a first side of the printed substrate member and having a ground plane on a second side of the printed substrate member, the contact beam being coupled to the signal conductor, the connector forming a printed circuit edge (PCE) receiving slot; and a flexible printed circuit (FPC) that extends from outside the connector into the PCE receiving slot such that the contact beam in the connector makes electrical contact with a conductor in the FPC from one side of the FPC only, wherein when the FPC is in the PCE receiving slot a side of the FPC opposite the contact beam is in contact with a portion of the connector that is stiffened by the stiffening member, wherein the stiffening member is metal and is not in electrical contact with the contact beam, a conductive path extending from the conductor in the FPC, through the contact beam, through the surface mount attachment structure, and to the conductor in the SMS, wherein the FPC has signal conductors and around conductors disposed in a microstrip geometry, and wherein the printed substrate member also has signal conductors and ground conductors that are disposed in a microstrip geometry.

8. The assembly of claim 7, wherein the contact beam does not contact any two sides of the FPC.

9. An assembly, comprising:

a surface mount substrate (SMS) having a conductor;

a connector comprising an insulative housing, a printed substrate member retained in the insulative housing, a contact beam coupled to the printed substrate member, a stiffening member, and a surface mount attachment structure, the surface mount attachment structure being connected to the SMS so that the connector is surface mounted onto the SMS, the printed substrate member having a signal conductor on a first side of the printed substrate member and having a ground plane on a second side of the printed substrate member, the contact beam being coupled to the signal conductor, the connector forming a printed circuit edge (PCE) receiving slot; and a flexible printed circuit (FPC) that extends from outside the connector into the PCE receiving slot such that the contact beam in the connector makes electrical contact with a conductor in the FPC from one side of the FPC only, wherein when the FPC is in the PCE receiving slot a side of the FPC opposite the contact beam is in contact with a portion of the connector that is stiffened by the stiffening member, wherein the stiffening member is metal and is not in electrical contact with the contact beam, a conductive path extending from the conductor in the FPC, through the contact beam, through the surface mount attachment structure, and to a conductor in the SMS, wherein the printed substrate member includes a pair of parallel extending ground conductors disposed on the first side of the printed substrate member, and wherein the printed substrate member includes a pair of signal conductors disposed on the first side of the printed substrate member, the pair of signal conductors extending parallel to one another between the pair of ground conductors, and wherein the ground conductors are coupled through the printed substrate member to the ground plane on the second side of the printed substrate member.

10. The assembly of claim 9, wherein the assembly is part of a laptop computer, wherein signals pass from a first panel of the laptop computer, through the connector, and to a display mounted in a second panel of the laptop computer.

11. The assembly of claim 9, wherein the SMS is an integrated circuit carrier, the integrated circuit carrier being surface mounted to a printed circuit board.

12. The assembly of claim 9, wherein the printed substrate member is taken from the group consisting essentially of: a printed circuit board (PCB) and a flexible printed circuit (FPC).

13. The assembly of claim 9, wherein the conductive path that extends from the conductor in the FPC, through the contact beam, through the surface mount attachment structure, and to a conductor in the SMS has a characteristic impedance that varies by less than plus or minus ten percent.

14. The assembly of claim 9, wherein the portion of the connector that is stiffened by the stiffening member is the stiffening member.

15. An FPC edge connector having a printed circuit edge (PCE) receiving slot, the FPC edge connector comprising:

an insulative housing that forms the PCE receiving slot having a contact beam therein; and means, positioned in the housing, for making electrical contact with a conductor of a flexible printed circuit (FPC) that is inserted into the PCE receiving slot such that a conductive path is established from the conductor of the FPC, through a microstrip signal conduction path, and to a printed circuit board upon which the FPC edge connector is mounted, wherein the conductive path has a characteristic impedance that varies by less than plus or minus ten percent, wherein the means comprises: a printed circuit substrate; and the contact beam that is coupled to the printed circuit substrate.

16. The FPC edge connector of claim 15, wherein the microstrip signal conduction path is a path through the printed circuit substrate.

17. The FPC edge connector of claim 15, wherein the contact beam only makes contact with one side of the FPC when the FPC is inserted into the PCE receiving slot.

18. The FPC edge connector of claim 17, wherein there is no conductor in the FPC edge connector that is electrically coupled to the contact beam and that is also disposed on a side of the FPC opposite the side of the FPC that makes contact with the contact beam.

19. The FPC edge connector of claim 15, wherein the FPC edge connector includes no fork-shaped metal clamp contact for contacting two sides of the FPC.

* * * * *